US005841878A

United States Patent [19]

Arnold et al.

[11] Patent Number: 5,841,878

[45] Date of Patent: Nov. 24, 1998

[54] MULTIMEDIA COLLECTIBLE

[75] Inventors: John J. Arnold, 40 Maple St., Roslyn Heights, N.Y. 11577; Lawrence I. Wechsler, Great Neck, N.Y.

[73] Assignee: John J. Arnold, Roslyn Heights, N.Y.

[21] Appl. No.: 600,851

[22] Filed: Feb. 13, 1996

[51] Int. Cl.[6] ..... G09F 27/00

[52] U.S. Cl. ..... 381/124; 40/124.03; 40/717; 40/906; 704/272

[58] Field of Search ..... 381/124, 61; 40/124.03, 40/717, 906; 704/272

[56] References Cited

U.S. PATENT DOCUMENTS

| | | | |
|---|---|---|---|
| 3,865,475 | 2/1975 | Hardy et al. . | |
| 3,909,512 | 9/1975 | Omori et al. . | |
| 4,195,431 | 4/1980 | Neufeld | 40/544 |
| 4,372,068 | 2/1983 | Knapp et al. | 40/367 |
| 4,990,092 | 2/1991 | Cummings . | |
| 5,146,353 | 9/1992 | Isoguchi et al. . | |
| 5,182,872 | 2/1993 | Lee et al. . | |
| 5,359,374 | 10/1994 | Schwartz . | |
| 5,475,399 | 12/1995 | Borsuk | 345/130 |
| 5,480,156 | 1/1996 | Doederlein et al. . | |
| 5,522,163 | 6/1996 | Neugebauer | 40/780 |
| 5,544,438 | 8/1996 | Fazeras | 40/605 |
| 5,648,712 | 7/1997 | Hahn | 320/2 |

*Primary Examiner*—Forester W. Isen
*Attorney, Agent, or Firm*—Wechsler & Wechsler, P.C.; Lawrence I. Wechsler

[57] ABSTRACT

A collectible article provides a multimedia representation of a desired subject. Such multimedia representation will include a visual representation of the subject appearing on at least a portion of the article. In addition to such visual media, an audible sound segment, reproducible and selectively activated as desired by an activation switch. The article is advantageously of compact, card-like format, and can be user personalized by permitting the recording, and selective playback, of a sound segment corresponding to the visually depicted image appearing on a portion thereof. The article may optionally include a space reserved for receiving an autograph. By carrying the article to places where there may be a likelihood of encountering the depicted celebrity, the owner will have same at hand for personalization by the figure. A spoken message to the presenting owner of the card-like article may there be recorded by the celebrity for long term storage and future playback, and/or the card signed in the appropriate location thereon. The article may further include displayed statistical information and the like disposed on an reverse side of the card, conveniently in the form of, for example, a liquid crystal alphanumeric display, or the like, which includes one or more rows. In a further embodiment, the above features are incorporated in a protective housing for display of existing trading cards and the like.

8 Claims, 5 Drawing Sheets

MULTIMEDIA COLLECTIBLE

BACKGROUND OF THE INVENTION

The present invention relates to a collectible article suitable for investment, trade, personal hobby or other like use, and more particularly to a collectible article of card-like format directed to a particular subject of interest, the article presenting representational information in more than one medium for capturing a greater sensory dimension, for example, providing an audible playback of a soundtrack segment related to a visual image represented thereby.

Collecting memorabilia has long been a popular diversion for many, appealing to individuals, for example, interested in accumulating articles which represent a link to a person, or topic, of interest. The nature of these collectible mementos is varied, and may include, for example, voice recordings of a personality captured on record, tape or compact disc, photographs or printed advertising media, card sets, etc. Some collectors concentrate on obtaining autographs from celebrities, or purchase letters sent by these persons to other parties. Depending upon scarcity of a particular autograph, and the popularity of the signatory, the value may be quite high, adding to the appeal of such a hobby. Many sound recordings also demand high prices and therefore may represent a viable investment. These collectibles, however, from an entertainment standpoint, generally provide only a one-dimensional representation of the subject matter depicted thereby, and therefore the medium of each fails to fully capture the feel of an event, or adequately memorialize a popular individual.

A variety of other mass produced articles are also quite popular with collectors. Public demand for display collectibles, such as including, for example, baseball and other sport cards, as well as related memorabilia, has increased greatly in recent years. Articles commemorating anniversaries of a movie release are also popular, including such items, for example, as limited edition trading cards depicting the celebrities or various scenes appearing therein. Such articles are generally produced as a numbered set, thereby encouraging the trading of individual cards in an attempt to obtain a missing card, and creating additional demand therefor. In an attempt to further increase market demand, many manufacturers of such items have attempted to increase the visual appeal of the image contained thereon by including an enhanced border of foil or other decorative material, or by embossing or creating a relief on portions of the article's viewed surface.

Because of the potentially high monetary value of some card collectibles, card protectors have been produced to enable display and/or storage of the card. Such card protectors are generally constructed of two panels of clear plastic separated by a minimal gap between which a single card is received. The structure is either sleeve-like, having an opening at one end for slidably receiving the card, or of alternative structure permitting one of the panels to be separated from a remainder of the protector for insertion of the card into a receiving space and permitting subsequent secured replacement of the panel. When placed in such a card protector, the card may be freely viewed and enjoyed while being shielded from external factors which might otherwise cause damage thereto. Generally, these prior art card protectors do not supply media supplementary to that appearing on the card received therein, except perhaps a label indicating collection information, such as price paid, estimated value, or date of purchase.

Despite the above described attempts to improve visual aesthetics of the cards themselves, as well as to provide effective protective card holders for enhanced display or storage, such card collectibles and related items remain restricted in their representation of the subject to the depicted image printed on the surface of the card, and to the limited scope of a printed text which generally appears within a sharply restricted space on the reverse side thereof. Card protectors produced heretofore merely sought to prevent physical damaging of the card, and did nothing to supplement and enhance the material presented thereby. Card collectibles and card related items produced heretofore remain limited, therefore, in their capacity for capturing the feel of a memorialized event or of a famous person or other subject.

OBJECTS AND SUMMARY OF THE INVENTION

Accordingly, it is an object of the invention to provide a collectible article for display, investment or trade which overcomes the drawbacks of the prior art.

It is a further object of the invention to provide the collectible in a form which can provide multimedia representation of a person, place, event or other subject.

It is yet a further object of the invention to provide the collectible in a form which permits playback and optional recording capabilities of an audio segment corresponding to a visual image associated therewith, to achieve an added representational dimension.

It is a still further object of the invention to provide the collectible in a pocket-sized, compact card-like format suitable for display, as well as providing a portable configuration, for carrying to a remote location.

It is a still further object of the invention to provide the collectible in a form which permits display of textual information not limited by the physical size of the card-like format.

It is a yet a further object of the invention to provide the collectible in a mechanically simple, economically produced form, which enables reliable operation of the features of the article.

It is a yet a further object of the invention to provide the collectible in a form suitable for housing an existing trading card for display and protection, and which can also provide the above stated multimedia objects.

Briefly stated, there is provided an article, advantageously of portable configuration which provides a multimedia representation of a desired subject, including, for example, an individual, object, plant or animal, place or event, of either fact based or fictional origin. Such multimedia representation will include a visual representation of the subject appearing on at least a portion of the article, and may take any suitable form practiced for accomplishing display of a recognizable image. For example the image may be a photographic or artist rendition of the subject, either housed within an optically clear enclosed portion of the article, or applied directly to the outer surface of the article, conveniently, for example, in the form of a decal. Alternatively, the representation may be holographically reproduced, or may comprise a three dimensional sculpted figure, or a relief of flattened shape. In addition to such visual media, means are provided for reproducing an audible sound segment, the content of which is advantageously related to that of the visual representation, conveniently in the form of solid state electronic circuitry which may be selectively activated as desired, conveniently by depressing a button operating a playback activation switch. The body of the collectible article may be produced by known molding or fabricating techniques from any suitably adapted material, such as for example plastic or metal. Electronic circuitry may be suitably powered by a replaceable battery source receivable therein, or by other power means, including for example a rechargeable battery received in the article and rejuevinable when the article, or the battery itself when removed, is inserted into a charging base. Solar power may optionally be used to power the electronic components, or to extend battery life.

In an advantageous embodiment, the article, conveniently of compact, card-like format, provides means for personalization by the user, by permitting the recording, and selective playback, of a sound segment corresponding to the visually depicted image appearing on a portion thereof. The article may optionally include a space reserved for receiving an autograph of an actual person represented thereby. By carrying the article to places where there may be a likelihood of encountering the celebrity or sports figure, such as theaters, concerts, sporting events and sports bars, the individual will have same at hand for personalization by the figure. Should a request for such personalization be granted, a spoken message to the presenting owner of the card-like article may be recorded by the celebrity for long term storage and future playback, and/or the article signed in the appropriate location thereon. To record such personalized audio message, means are provided for engaging a record function, conveniently in the form of a recording pin, which when inserted into receiving hole, converts the above described button operated playback activation switch into a record activation switch, via electronic means responsive to the insertion thereof. When the button is depressed while the pin is in inserted engagement, the article provides a predetermined period within which a message or sound segment may be recorded. When the period for recording is concluded, removal of the recording pin prevents accidental erasure of the sound segment, and returns the function of the button operated switch to one of playback activation.

In a further embodiment, a card-like, portable format as described above, includes a visual representation on an obverse side of the card-like article. Means for viewing statistical information and the like, advantageously related to the article's subject matter, is disposed on a reverse side of the article, conveniently in the form of, for example, a liquid crystal alphanumeric display, or the like, which includes one or more rows. Means for incrementally retrieving rows of stored data is provided, conveniently in the form of a button operated data scroll switch, which when pressed repeatedly advances the displayed data row by row. This electronically represented data may optionally be supplemented with printed text, or other form of representative information, which would appear on a remaining portion of the reverse side.

In a particularly advantageous embodiment, a single button operated switch may be commonly employed for both record/playback of the message as well as data scrolling. When hand-held for viewing, the article will be generally oriented with the side to be viewed facing upwardly. Means are therefore provided for sensing the orientation of the card-like article, and for altering the function of the common switch in correlation with the perceived orientation. When the one side of the card-like article containing the visual representation is viewed, the button when depressed initiates playback of the stored audio segment. When the article is flipped over to view the reverse side, the function of the button operated switch is changed to one of data advancement, and repeated depression thereof permits scrolling of the stored textual data displayed on the reverse side. Insertion of the recording pin conveniently overrides both functions and converts the switch to a record button. Alternatively, insertion of the pin may be used only to convert the playback function into record mode when the image side of the article is upwardly disposed, or the text scroll mode to record when turned over. Still further, separate and distinct means for accessing the record mode may be employed, obviating interruption of the directional dependant changeover of operation of the common switch between playback and data advancement during recording.

In another embodiment, an article is provided which permits a collector of conventionally available trading cards to protect an existing card from damage during storage and display, the article further providing dimensional enhancement by permitting playback of a sound segment related to the subject of the card and/or supplementation of informational text. The sound segment may be provided as a prerecorded audio track, stored for example in non-volatile memory in the form of digital data for future playback by the individual. The article may optionally permit the individual to record a personalized audio message in place of, or in addition to, an unalterable prerecorded track. An additional option may further permit retrieval of stored alphanumeric data, such as supplementary textual information related to the card being stored and displayed. Such data may include for example statistics of a sports figure, or factual data related to a non-sports subject represented by the particular card.

In yet another embodiment, a kit comprising one or more card-like articles and a charging base is provided, which enables an individual to strive to collect all elements of the complete set, and the charging base ensuring that the individual card-like articles are fully powered as the need may arise to record a message, or to playback an existing sound segment. The charging base would include one or more receiving slots, at least a portion of which would include means for transferring charging power to the article when inserted therein. The charging base would advantageously receive the base portion of the card-like article, on which would be disposed corresponding terminals for receiving charging voltage. Inserted only a small distance into the receiving slot, the base could function as a display stand for the collectible article when same was not being portably carried.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 10 is a plan view of an embodiment which permits display and audio enhancement of an existing trading card or the like;

DETAILED DESCRIPTION OF THE PREFERRED EMBODIMENT

Figure 1:
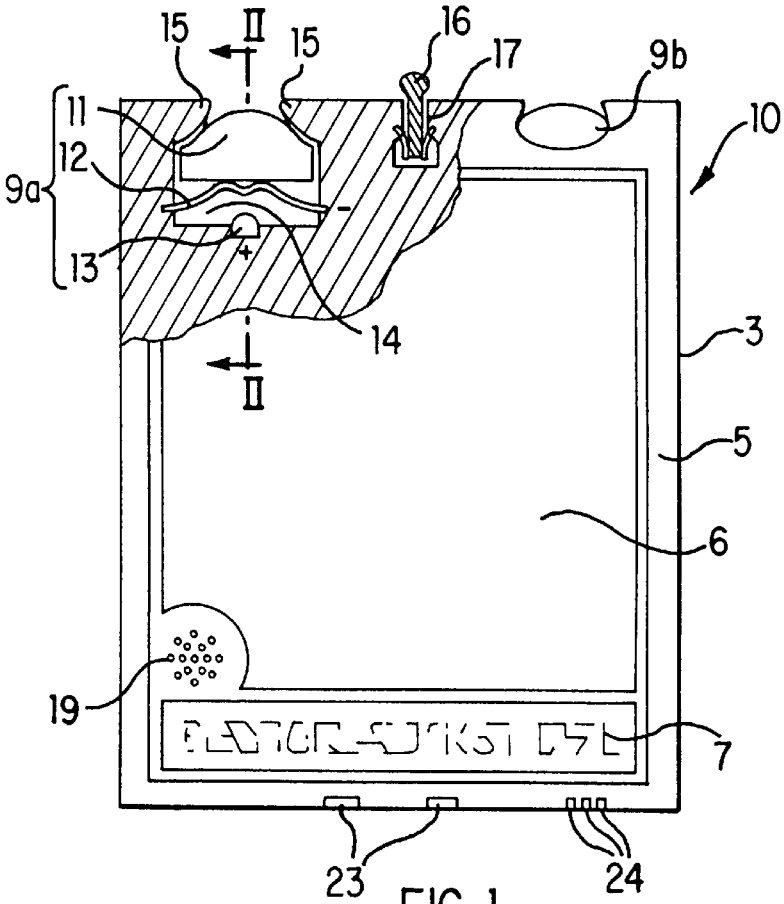
FIG. 1 is a plan view of a side of an embodiment of a card-like multimedia collectible article shown in partial cross-section in accordance with the invention.
Figure 2:
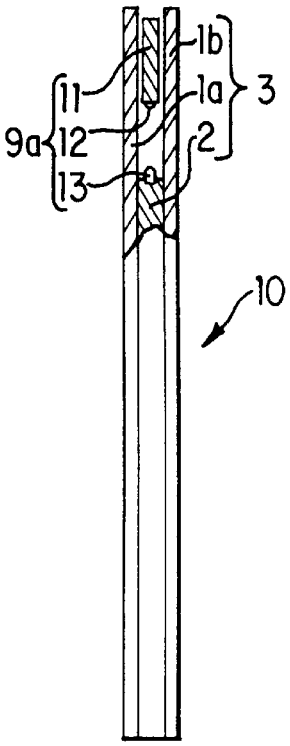
FIG. 2 is a partial cross-sectional view taken on line II—II in FIG. 1.
Figure 3:
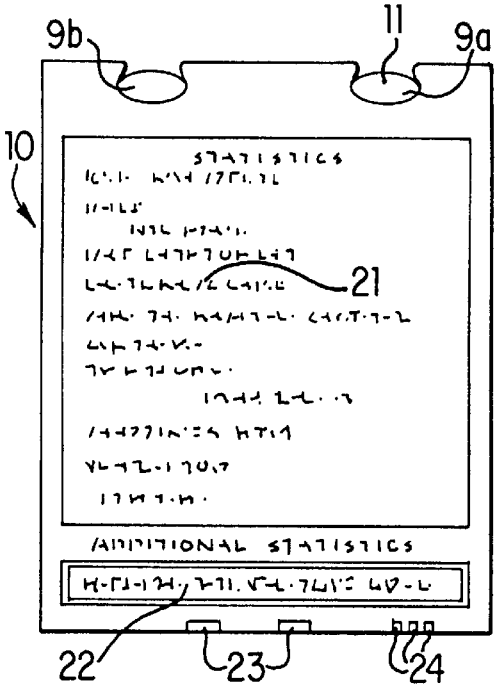
FIG. 3 is a plan view of the reverse side of the embodiment depicted in FIG. 1.

Referring now to the figures, and in particular FIGS. 1–3 there is depicted, in accordance with the invention, an embodiment of a multimedia collectible article, generally designated 10. Multimedia collectible 10 is advantageously of flattened, card-like configuration. Such format may be conveniently rectangular as shown, or may take another alternative shape. Advantageously, multimedia collectible 10 is also rigidly constructed. Although not critical to the invention, such portable form permits multimedia collectible 10 to be readily transported to a remote location for a desired purpose, as will be described in detail below. The embodiment as shown in FIGS. 1–3 includes a housing 3 which defines the overall size, shape and physical characteristics of multimedia collectible 10, conveniently provided as a laminated structure comprising first and second outer layers 1*a* and 1*b* and a separating layer 2 disposed therebetween. Separating layer 2 and first and second outer layers 1*a* and 1*b* are in engaged contact with one another along a commonly sized and shaped perimeter to provide housing 3 with a flattened three-dimensional form having smooth side edges. Formation of one or more cutouts in separating layer 2 provides a convenient means for providing chambers within housing 3 for receiving and containing various electronic and mechanical components required for operation of multimedia collectible 10, and for running circuitry interconnecting individual circuit elements physically separated from one another. In the embodiment as depicted, housing 3 includes an obverse side 5 on which is disposed, at least over a portion thereof, an image 6 of the subject matter to which multimedia collectible 10 is directed. Such subject may include, for example, an individual, object, plant or animal, place or event, of either fact based or fictional origin. The image 6 may be a photographic or artist rendition of the subject, and may be affixed to housing 3 in various acceptable manners. For example, a printed image may be placed between an optically clear first layer la and separating layer 2, or applied directly to the outer surface of the article, conveniently, for example, in the form of a decal. Alternatively, the representation may be holographically or electronically reproduced, or may comprise a three dimensional relief of flattened shape, conveniently formed directly in an outwardly facing surface of first layer 1. Where multimedia collectible 10 is directed to an actual person, a portion of front side 5 may optionally include a space 7 reserved for receiving an autograph of the individual. The space 7 may be a specially textured receptive finish disposed on the outwardly facing surface of first layer 1*a*, as depicted, thereby permitting multimedia collectible to be signed directly by the celebrity, or may alternatively be in the form of a slot formed between an optically clear first layer 1*a* and separating layer 2 for permitting reception of a signed autograph, thereby permitting display of, for example, a purchased autograph of a deceased celebrity when such is depicted by multimedia collectible 10. Such autograph may be slidably received through an opening for example formed at the side of multimedia collectible 10, or be received beneath a cover plate removably affixed to the outwardly facing surface of first layer 1*a*. Although such structure permitting reception of an existing autograph is not depicted, the many number of means suitable for accomplishing this end will be readily apparent to one of ordinary skill in the art.

Multimedia collectible 10 includes means for reproducing a stored sound segment advantageously related to the subject matter represented by the depicted image portrayed thereby. Sound segment data is conveniently stored, for example, in the form of digital data in non-volatile solid state memory conventionally available for such applications. The sound segment may be provided in a form which does not permit alteration by the individual, i.e. a prerecorded sound track of predetermined duration, as described herein also as a sound-byte. Such pre-recorded sound-byte may be provided, for example, pre-loaded and available with purchase of multimedia collectible 10. Alternatively, the sound segment may be purchased by the individual after purchase, for future use in conjunction with multimedia collectible 10. In this way, multimedia collectible 10 need not be dedicated to any particular subject during manufacture. For example, a blank device, structurally complete, with the exception of visual and audio initialization, may be sold with a placable decal or sticker depicting the subject for future application thereto, along with a memory chip containing sound segment data corresponding to the same subject which would be plugged into a user-accessible receptacle included in multimedia collectible 10 by the purchaser. For purposes of economy, decals and chips could also be sold separately to permit upgrading of an existing device should the individual tire of the subject already being depicted thereby, obviating the need to purchase a replacement multimedia collectible 10. Alternatively, the data may be uploaded from an external source into a blank memory chip purchased pre-installed, as described later herein.

Means for selectively initiating playback of the stored sound segment are provided, for example in the form of an activation switch 9*a*. Although its positional placement, as with any of the other elements placed in or along the housing, is merely a design choice, activation switch 9*a* is conveniently located in a position proximal a top edge of multimedia collectible 10. Activation switch 9*a* includes a depressible button 11, a spring loaded contact 12 which upwardly biases button 11, and a contact 13 which closes the circuit when button 11 is depressed to urge spring loaded contact 12 into conductive contact with contact 13. Means responsive to a closing of activation switch 9*a* begins playback of the sound segment, conveniently provided as part of electronic playback circuitry disposed within housing 3, the operation of which will be described in greater detail below. Activation switch 9*a* is provided economically and efficiently by disposing the aforementioned switch elements directly within a switch chamber 14 formed by creating an appropriately shaped cut-out in separating layer 2. When housing 3 is fully assembled, all elements are captively held within switch chamber 14. Since multimedia collectible 10 is optionally intended for portable use, and will likely be kept in a pocket or similar location during transportation, button 11, while in an upwardly biased position, is advantageously recessed from the top edge of housing 3, to prevent unintentional playback activation. Activation switch 9*a* may be further shielded from accidental activation by providing an obstruction above button 11, conveniently in the form of overhanging portions 15 formed in first and second layers 1 and 2, as well as in separating layer 3.

Figure 4A:
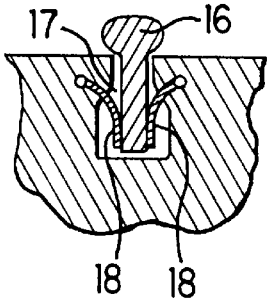
FIG. 4*a* is a cross-sectional detail depicting a recording pin in inserted position.
Figure 4B:
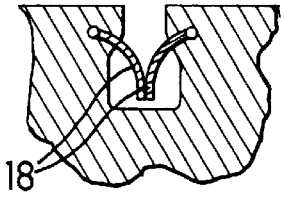
FIG. 4*b* is a cross-sectional detail as in FIG. 4*a*, with recording pin removed.
Figure 9:
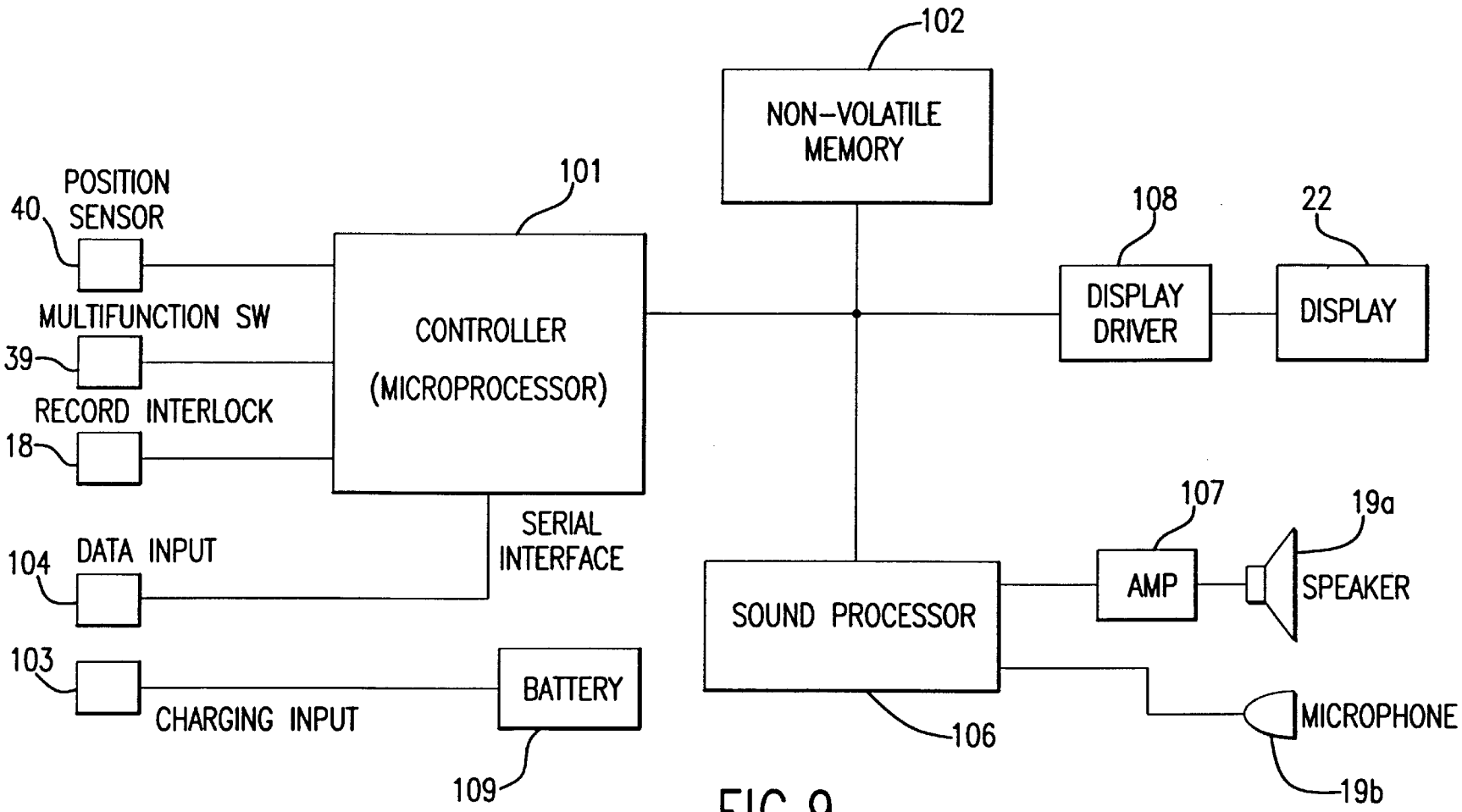
FIG. 9 is a block schematic diagram of a circuit embodiment of a multimedia collectible in accordance with the invention.

Optionally, multimedia collectible 10 may provide the individual with means for recording a personalized message for storage and future playback as desired, in place of, or in addition to the aforementioned user-unalterable prerecorded message. Multimedia collectible 10, conveniently of compact, card-like format, could then be easily transported to places where there may be a likelihood of encountering the celebrity or sports figure, such as theaters, concerts, sporting events and sports bars, and the individual would have same at hand for personalization by the figure. Should a request for such personalization be granted, a voiced message to the presenting owner of card shaped multimedia collectible 10 may be recorded by the celebrity for long term storage and future playback, and/or the card-like article signed in the appropriate location thereon, i.e. space 7. Although in accordance with the invention a separate switch dedicated to initiating recording of a sound segment may be provided in addition to activation switch 9*a*, the present embodiment advantageously provides means for selectively changing the mode of operation of activation switch 9*a* between one of initiating playback and another of initiating recording. This is conveniently accomplished, for example, by means of a recording pin 16, the presence or absence of which within a receiving chamber 17 determines the particular operational mode of activation switch 9*a*. As shown in detail in FIG. 4*a*, a pair of inwardly biased contacts 18 are maintained in a separated condition by recording pin 16 when same is in received engagement within receiving chamber 17. When receiving pin 16 is removed, as shown in FIG. 4*b*, inwardly biased contacts make electrical contact with one another. Since receiving pin 16 is comprised of a non-conductive material, a circuit connected across inwardly biased contacts 18 is open when recording pin 16 is inserted, and is alternatively closed upon removal thereof. When recording pin 16 is in inserted engagement within receiving chamber 17, means responsive to the opening of a circuit across inwardly biased contacts 18 changes the mode of operation of activation switch 9*a* to one in which depression of button 11 activates recording of a sound segment of predetermined duration. When inwardly biased contacts 18 close in response to removal of recording pin 16, mode of operation of activation switch 9*a* is correspondingly returned to one allowing only playback activation, thereby preventing accidental erasure of the recorded track. It will be understood that since the switching elements of the invention are adapted for use with a variety of suitable operational circuits providing in part such means responsive to opening and closing of contacts determined by presence or absence of recording pin 16, for example ones utilizing microprocessor technology, an operational embodiment of which will be described below in detail, many combinations of switching states corresponding to desired function are contemplated. For example, recording pin 16 as described above may be designed to close a pair of contacts when inserted rather than separate them, and such design configuration could alternatively be used with equal effectiveness to allow recording only when recording pin 16 is inserted within receiving chamber 17 simply by reversing logic operators in the microprocessor. A grill 19 conveniently comprised of a plurality of perforated holes formed through first layer 1*a*, behind which is located audio/signal conversion means such as, for example, a microphone 19*b* and a speaker 19*a* (shown in FIG. 9) disposed within housing 3, allows effective transfer of sound between the interior and exterior of housing 3.

Turning now to FIG. 3 a reverse side of multimedia collectible 10 includes other visual data, advantageously in the form of textual information 21 to supplement and enhance the pictorial representation on the front side thereof. Such data may be affixed to housing 3 in a manner equivalent to that described with respect to image 6. For example, text 21 may be a printed decal applied to an exterior of second layer 1*b*, or may be embossed text, conveniently formed directly in second layer 1*b* during molding thereof.

Because of the overall size of multimedia collectible 10 is advantageously limited, space available for text 21 is correspondingly limited. Therefore, optionally, multimedia collectible may include a display 22 providing means for visually displaying stored alphanumeric data in addition to the fixed text 21. Display 22 may consist of any display device suitable for visually reproducing readable text. For example, as depicted, display 22 may be at least one row comprised of a plurality of segmented liquid crystals, to permit retrieval of a retrieved row of text from stored memory. A scroll switch 9*b* is conveniently disposed along a top edge of multimedia collectible 10, in equivalent fashion to that described with reference to activation switch 9*a*. Scroll switch 9*b* is conveniently of identical structure to activation switch 9*a*. Means responsive to a closing of scroll switch 9*b* are provided, for example as part of the aforementioned microprocessor circuitry which may be used to control a remainder of operations, for incrementally scrolling through alphanumeric data stored in memory. For example, where display 22 permits display of only a single row of characters, such means for scrolling would cause the next row of data stored in memory to be displayed each time scroll switch 9*b* was depressed by the individual. Where display 22 instead comprises multiple rows of characters, depressing scroll switch 9*b* could be made to optionally advance data in single row increments, resulting in upward displacement of the previously displayed rows, or alternatively in multiples equal to the number of rows of display 22, thereby completely replacing the data displayed each time switch 9*b* is pressed. The above described alphanumeric data could be stored at point of manufacture, or could be supplemented by the purchaser at a later date, as described above with regard to the various means for acquisition of audio data. An example of such means for accomplishing the imputing of such supplemental data digitally will be described in detail as part of an operational description.

It is noted that although only one display 22 is depicted in, and described with respect to FIG. 3, it is contemplated herein that a multimedia collectible in accordance with an embodiment of the invention may include two or more such displays for "multi" screen display of information or statistics. Such information may be displayed with or without the feature enabling scrolling as previously described. In the former case, multiple button operated switches of structure and function equivalent to that of scroll switch 9*b* would be provided in convenient locations corresponding to each screen.

Figure 5:
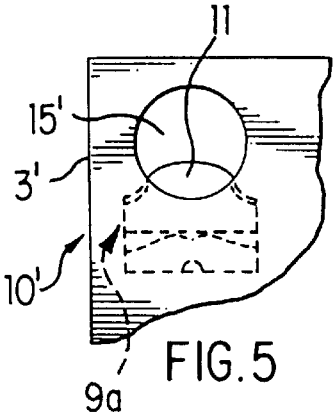
FIG. 5 is a partial detail of another embodiment in accordance with the invention depicting an advantageous button placement.

FIG. 5 depicts an alternate embodiment of a multimedia collectible 10' in which activation button 11 is disposed so as to protrude into an access hole 15' formed through a housing 3'. All other components and operation of activation switch 9*a* are equivalent to those described with respect to FIGS. 1 and 2. To activate playback, the individual inserts a finger through access hole 15' and depresses button 11. This configuration advantageously deters accidental playback activation. Although not shown, scroll switch 9*b* is equivalently configured to achieve the same advantages.

Figure 6:
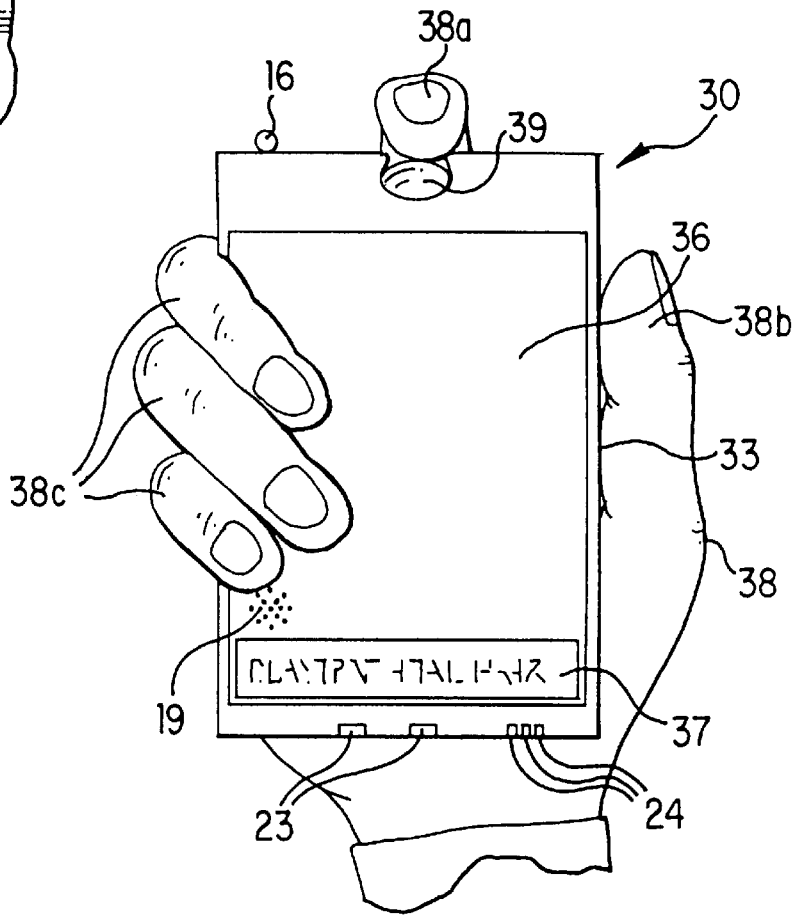
FIG. 6 is a plan view of another embodiment in accordance with the invention, including orientation sensor and single button operation.

Turning now to FIG. 6, an embodiment of a multimedia collectible in accordance with the invention is depicted, generally designated 30, which permits alternate sound segment playback initiation and textual scrolling by operation of a single switch 39. Switch 39 is advantageously centrally disposed along a top edge of multimedia collectible 30, recessed therefrom and equivalently configured to switches 9*a* and 9*b* of the previous embodiment to achieve the aforementioned advantages regarding accidental switch depression. With the exception of providing single button operation, multimedia collectible 30 is equivalent in all other respects to multimedia collectible 10 including for example on an obverse side of a housing 33 as shown, an image 36 and a place to receive an autograph 37.

The compact, card-shaped envelope of the illustrated embodiment permits multimedia collectible 30 to be held in a one hand 38, typically as shown in FIG. 6. A forefinger 38*a* of hand 38 is in position to depress switch 39, while a thumb 38*b* and remaining fingers 38*c* support multimedia collectible 30 from opposed sides. The reverse side of housing 33 rests on the palm of hand 38. As with most card-like display items, multimedia collectible 30 is invariably held at a comfortable level and a distance away from the body of the individual, and viewed from above, with the viewed side of multimedia collectible facing upwardly, but at a slight incline away from the body. By virtue of this typical viewing orientation, a determination of physical orientation in the hand of the individual may be used with reasonable certainty to ascertain which side is being viewed. Means are therefore provided for detecting which of the two sides of multimedia collectible 30 is oriented in an upwardly facing direction. To permit single switch operation of audio and scrolling features, means, responsive to such detection, are also provided for changing the mode of switch 39 from one of playback activation to one of incremental text scrolling when the front and reverse side of multimedia collectible 30 are upwardly disposed, respectively.

Figure 7:
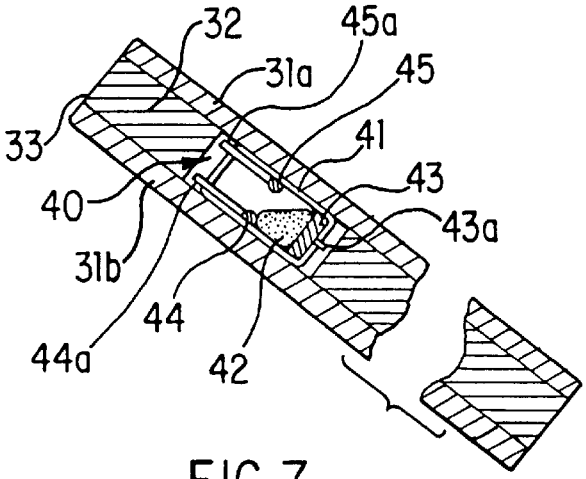
FIG. 7 is a cross-sectional side view of the embodiment depicted in FIG. 5 shown in detail and illustrating operation of an orientation sensor utilizing a mercury bead.

Referring now to FIG. 7, an embodiment of such means for detecting is shown in which a position detector 40 is shown in housing 33, disposed between first and second layers 31*a* and 31*b*, within a chamber formed in a separating layer 32. Detector 40 includes a capsule 41 which is conveniently of elongated cylindrical shape, in which is sealed a confined bead of mercury 42. A ground contact 43 is disposed on the interior of capsule 41, disposed at a bottom end thereof. A playback activation contact 44 is disposed along an inside wall of capsule 41, in a radial position nearest the reverse side of multimedia collectible 30, i.e. adjacent second layer 31*b*. A corresponding text scrolling contact 45 is disposed in an opposite radial position, adjacent first layer 31*a*. Leads 43*a*, 44*a* and 45*a* are connected to ground contact 43, playback activation contact 44, and text scrolling contact 45, respectively, and extend to the outside of capsule 41 for connection to control circuits of multimedia collectible 30. By virtue of such configuration, when the front of multimedia collectible 30 which is disposed on first layer 31*a* is being viewed as shown, mercury bead 42 closes a circuit between ground contact 43 and playback activation contact 44. Although not depicted, when the reverse side of multimedia collectible 30 is viewed, and second layer 31*b* is upwardly disposed, the above circuit is opened, and mercury bead 42 instead electrically connects ground contact 43 and text scrolling contact 45. Means responsive to the relative closures, conveniently provided as part of a microprocessor controller which to be described in greater detail below, are employed for changing the operation of switch 39 to a corresponding mode.

Figure 8:
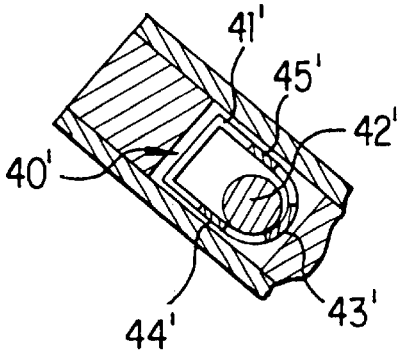
FIG. 8 is an alternate embodiment of an orientation sensor utilizing a ball bearing.

Referring now to FIG. 8, an alternate embodiment of a detector is shown, generally at 40', which obviates the use of mercury, belaying potential environmental concerns. A capsule 41' in the shape of an elongated cylinder contains a conductive ball bearing 42'. Ball bearing 42' has a diameter less than an internal diameter of capsule 41' allowing ball bearing 42' to freely move about within capsule 41'. A ground contact 43', a playback activation contact 44', and a text scrolling contact 45' are arranged in respective positions equivalent to those described with respect to the preceding embodiment. However, since ball bearing 42' is solid, rather than a liquid mercury bead, these contacts are advantageously flush with the inner surface of capsule 41' to permit ball bearing 42' to roll smoothly, thereby insuring reliable operation. Furthermore, there is no need for capsule 41' to be hermetically sealed, as is essential where mercury is used. Since only the weight of ball bearing 42' against each of the contacts bridged thereby while in a particular orientation provides contact pressure, optionally, means for comparing measured resistances between ground contact 43' and each of playback activation contact 44' and text scrolling contact 45', and for determining which is less. By using this result to correlate the position of multimedia collectible a greater degree of reliability is thought to be achieved.

As with the previously described embodiment, insertion of recording pin 16 conveniently overrides both functions and converts switch 39 to an operation which operates the recording mode. Alternatively, insertion of recording pin 16 may be used only to convert the playback function into a record mode when the front side of multimedia collectible 30 is upwardly disposed, or the advancement mode to record when turned over, and the reverse side thereof is upwardly disposed. Still further, separate and distinct means for accessing the record mode may be employed, obviating interruption of the direction dependant changeover of operation of common switch 39 between playback and data scroll during recording.

As previously noted, the various electronic functions of the above described embodiments may be advantageously provided utilizing currently available solid state memory and sound reproduction circuitry, while operation thereof is conveniently controlled by microprocessor technology. Operation of multimedia collectibles 10 and 30 will now, therefore, be described with reference to the block diagram of FIG. 9, in which a circuit is shown, generally at 100. Electronic circuit portion 100 of, for example multimedia collectible 30 in accordance with the invention, and as previously described with reference to FIGS. 6–8, comprises a microprocessor based controller 101, which, based on data received from three sensor inputs, i.e. position sensor 40, multifunction switch 39, and record interlock switch 18, displays selected alphanumeric text or graphics on display device 22, reproduces an audio segment consisting of voice, music or other sound effect through an audio transducer or speaker 19*a* disposed behind grill 19 (shown in FIG. 6), acquires and stores a short segment of audio material as detected by an audio transducer or microphone 19*b* also disposed behind grill 19, or permits the storage or readout of digitally encoded data, contained in a non-volatile memory device 102, corresponding to the audio or visual data to be reproduced by, or having been acquired by, multimedia collectible 30. A charging input 103 and a data input 104 are used respectively to provide battery charging current for a rechargeable battery 109 and to interface to the controller for purposes of uploading or downloading visual, alphanumeric or audio data. These are electrically communicative with external contacts 23 and 24, respectively (shown in FIGS. 3 and 6). It is noted that configuration of contacts 23 and 24 may in practice differ from those shown in FIG. 3, for example utilizing standardized data transmission couplings for data contacts 24.

Audio acquisition and storage is performed by disabling the record interlock switch 18, accomplished by insertion of recording pin 16, and depressing multifunction switch 39. Audio signals picked up by audio transducer or microphone 19*b* are digitized and processed by a sound processor 106 and stored in non-volatile memory device 102 by controller 101. Acquisition is terminated upon re-enabling the record interlock switch 18 effected by removal of recording pin 16, releasing multifunction switch 39, or upon the filing of available space in non-volatile memory 102.

Playback of audio material is performed by depressing multifunction switch 39 when the record interlock switch 18 is enabled, and position sensor switch 40 indicates that the image side, i.e. the obverse side of multimedia collectible 30 is facing upward. Previously stored, digitized and appropriately processed audio data from non-volatile memory 102 is fed by controller 101 to sound processor 106 which regenerates the audio signal, which is then amplified by an amplifier 107 to drive speaker 19*a*.

Display of visual data on display 22 is performed by pressing multifunction switch 39 when the record interlock switch 18 is enabled, and position sensor switch 40 indicates that the display side, i.e. the reverse side of the collectible is upwardly oriented. Previously stored, digitized and appropriately processed visual data from the non-volatile memory 102 is fed by controller 101 to a display driver 108 which formats the data for presentation on display 22. Depending upon the amount of alphanumeric/visual data available for display, multifunction switch 39 may be repeatedly pressed to scroll the displayed image, as has been previously described.

An external device, not a part of the device herein described, by appropriately signaling controller 101 through data input 104 can direct that controller 101 upload or download visual or audio data in digital form to/from non-volatile memory 101. This feature permits long-term backup disk storage of data held in non-volatile memory 101, offering protection against accidental erasure and/or battery failure, and further allows digital acquisition of audio and alphanumeric data from an externally supplied source.

Controller 101 may conveniently include, for example, any one of many low power microcontrollers commercially available. Non-volatile memory 102 may, for example, be any type of commercially available NVRAM, CMOS flash memory, EEPROM, or ultra low power static RAM with its own battery supply, or any combination of such devices. Sound processor 106 may include, for example, any one of many commercially available digital audio signal processors. Alternatively, the functions of controller 101, sound processor 106 and display driver 108 could be combined into a single ASIC (application specific integrated circuit) to reduce cost and simplify the manufacture of a multimedia collectible in accordance with the invention incorporating same. Display 22, as previously noted, may be, for example, a simple single or multiple line character-only liquid crystal display (LCD), as well as a monochromatic graphic LCD, or any form of color LCD panel.

Figure 10:
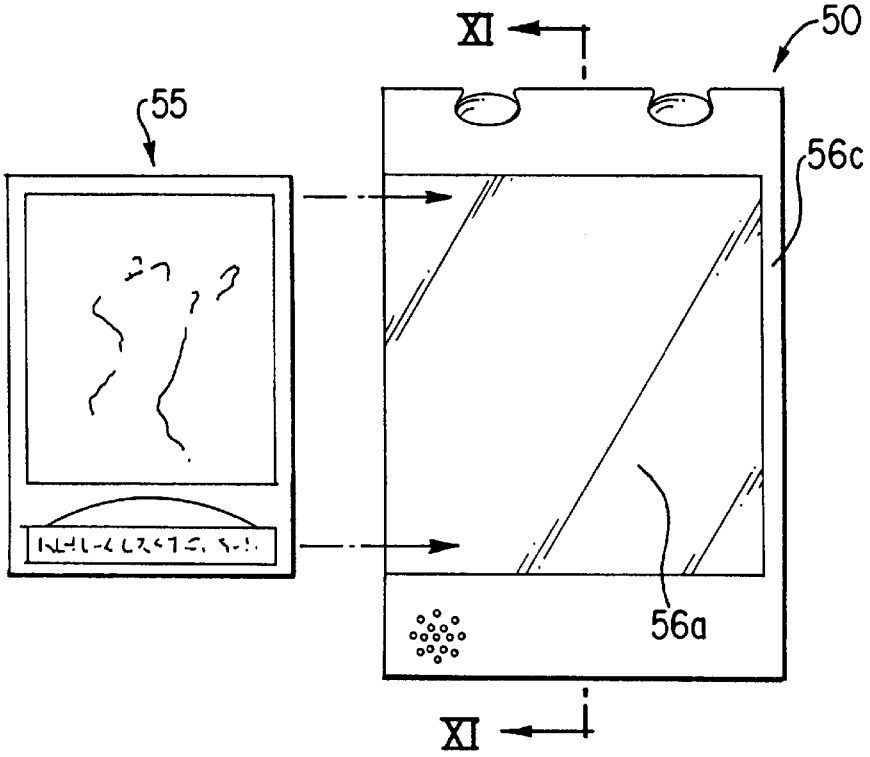
Figure 11:
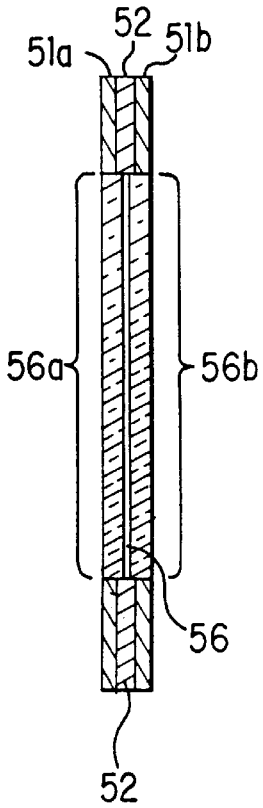
FIG. 11 is a cross-sectional view taken on line XI—XI in FIG. 10.

Turning now to FIGS. 10 and 11, a further embodiment of a multimedia collectible in accordance with the invention is depicted, generally designated 50. Multimedia collectible 50 is configured to permit a collector of conventionally available trading cards or other similar card-like display items to protect such an existing card 55 from damage during storage and display, while further providing dimensional enhancement by permitting playback of a sound segment advantageously related to the subject of card 55 and/or alphanumeric supplementation of informational text appearing thereon. Multimedia collectible 50 includes structure permitting the viewing of card 55 when same in received therein, conveniently in the form of first and second outer layers 51*a* and 51*b*, each which includes at least transparent portions 56*a* and 56*b* overlying an obverse and reverse of card 51, respectively. Means for captively receiving card 55 between first and second outer layers 51*a* and 51*b* are provided, conveniently in the form including an internally disposed receiving chamber 56 formed between first and second outer layers 51*a* and 51*b*. Receiving chamber 56 is internally bounded by a perimeter defined by a cut-out in separating layer 52. By providing at least one of first and second outer layers 51*a* and 51*b* with a protruding central region of a shape matching the cutout in separating layer 52 (both first and second outer layers 51*a* and 51*b* being depicted as so configured in the embodiment depicted in FIG. 11), receiving chamber may be made as thin as desired to allow for proper receptional fit of card 55, while permitting sufficient thickness of separating layer 52 to allow accommodation of electronic and mechanical components when same are placed in cutouts therein as described above with regard to the preceding embodiments. In a manner analogous to the previously described embodiments, first and second outer layers 51*a* and 51*b*, and separating layer 52, are in engaged contact with one another along commonly sized and shaped outer perimeters to provide a housing 53 having a flattened three-dimensional form including smooth side edges. Means for externally accessing receiving chamber to permit reception of card 55 therein is provided, conveniently in the form of an opening in receiving chamber on one side of multimedia collectible 50 through which card 55 may slidably inserted into receiving chamber. Other means for accessing a receiving chamber in which card 55 may be held for viewing alternative to a side opening as depicted may be provided without departure from the invention. For example, receiving chamber 52 may be fully enclosed, and multimedia collectible 50 provided with means for temporarily removing either first layer 51*a* or second layer 51*b* to allow card 55 to be placed into receiving chamber 52, prior to replacing removed first layer 51*a* or second layer 51*b* into engagement with a remainder of housing 53. Any or all of the aforementioned multimedia features and capabilities described with reference to the preceding embodiments may likewise be incorporated in multimedia collectible 50. For example, a sound segment may be provided as a prerecorded audio track for future playback by the individual, or multimedia collectible 50 may optionally permit the individual to record a personalized audio message in place of, or in addition to, the unalterable prerecorded track. Similarly, an additional option may further permit retrieval of stored alphanumeric and other visual data, such as supplementary textual information related to the card being stored and displayed. Such textual data may include for example statistics of a sports figure, or factual data related to a non-sports subject represented by the particular card 55. It is noted, that because multimedia collectible 50 is provided with transparent portions 56*a* and 56*b*, and since various functional components are invariably disposed in adjacent regions both above and below receiving chamber 56, to avoid obscuring the view of the displayed card, circuitry required for electronic interconnection are advantageously disposed adjacent to receiving chamber 56, running through a peripheral region 56*c* which is optionally non-transparent for purposes of aesthetics.

Figure 12:
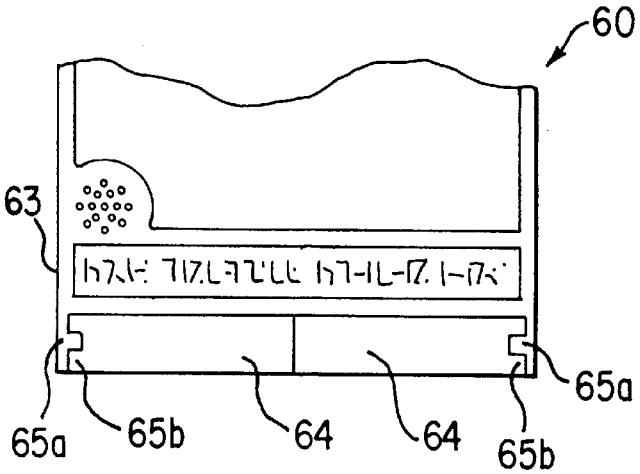
FIG. 12 is a partial plan view of an embodiment in accordance with the invention in which a housing permits base-supported vertical display of a card-like multimedia collectible article.
Figure 13:
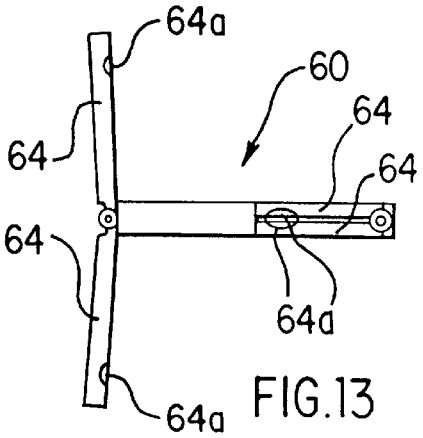
FIG. 13 is a bottom view of the embodiment of FIG. 12, showing support legs in folded and unfolded positions.

Turning now to FIGS. 12 and 13, an embodiment of a multimedia collectible in accordance with the invention is depicted, generally designated 60, in which means integral therewith are provided for permitting base-supported vertical display thereof when placed on a horizontal support surface. For purposes of illustration, with the exception of the additional supported display means, multimedia collectible 60 is shown with structure analogous to that of multimedia collectible 10 depicted in FIGS. 1–3. It is noted that the support features described with regard to the embodiment depicted in FIG. 12 can be effectively used also for any of the embodiments described herein. Their use is further contemplated with other embodiments not specifically presented herein, but nevertheless embraced within the scope of the invention as claimed. A housing 63 includes four support legs 64 hingably connected thereto along a lower edge thereof. Conveniently, housing will include integral hinge elements 65*a* cooperative with corresponding hinge elements 65*b* carried on terminal ends of support legs 64. When not in active use to base-support multimedia collectible 60, support legs 64 are folded together flush with the obverse and reverse sides of housing 63. Means are optionally provided (not shown) for retaining support legs 64 in the folded position in order to prevent unwanted unfolding during carrying and other than base supported display. This may be accomplished by any of a number of conventional means, such as a simple latch mechanism comprising a slightly raised portion carried on the lower edge of housing 63 and a corresponding indentation in support legs 64 for receiving the raised portion when moved to the folded position. The unfolding operation therefore requires the application of at least a gentle hand pressure to resiliently overcome the latch mechanism. Scalloped finger recesses 64a are optionally provided in a lower surface of support legs 64 to facilitate unfolding of support legs 64 into position for base supported display of multimedia collectible 60.

It is noted that any of the embodiments in accordance with the invention may be powered by any suitable portable means. For example, a replaceable battery source may be receivable within the collectible via battery compartment access means, or means may alternatively be provided for permitting charging of a rechargeable battery either removable from the housing of the collectible, or integral therewith and rejuevinable when the article is inserted into a charging base, the latter as described above with respect to the embodiments depicted in FIGS. 1–3 and 6. Additionally, conventional means may be employed to utilize solar power technology to power the electronic components, and/or to extend supplementary battery life.

In another embodiment, a kit comprising one or more card-like multimedia collectibles equipped with a rechargeable battery supply in combination with a charging base is provided. The individual may then strive to collect all card elements of the complete set, while the supplied charging base ensures that the individual cards are fully powered as the need may arise to record a message, or to playback an existing sound segment.

Figure 14:
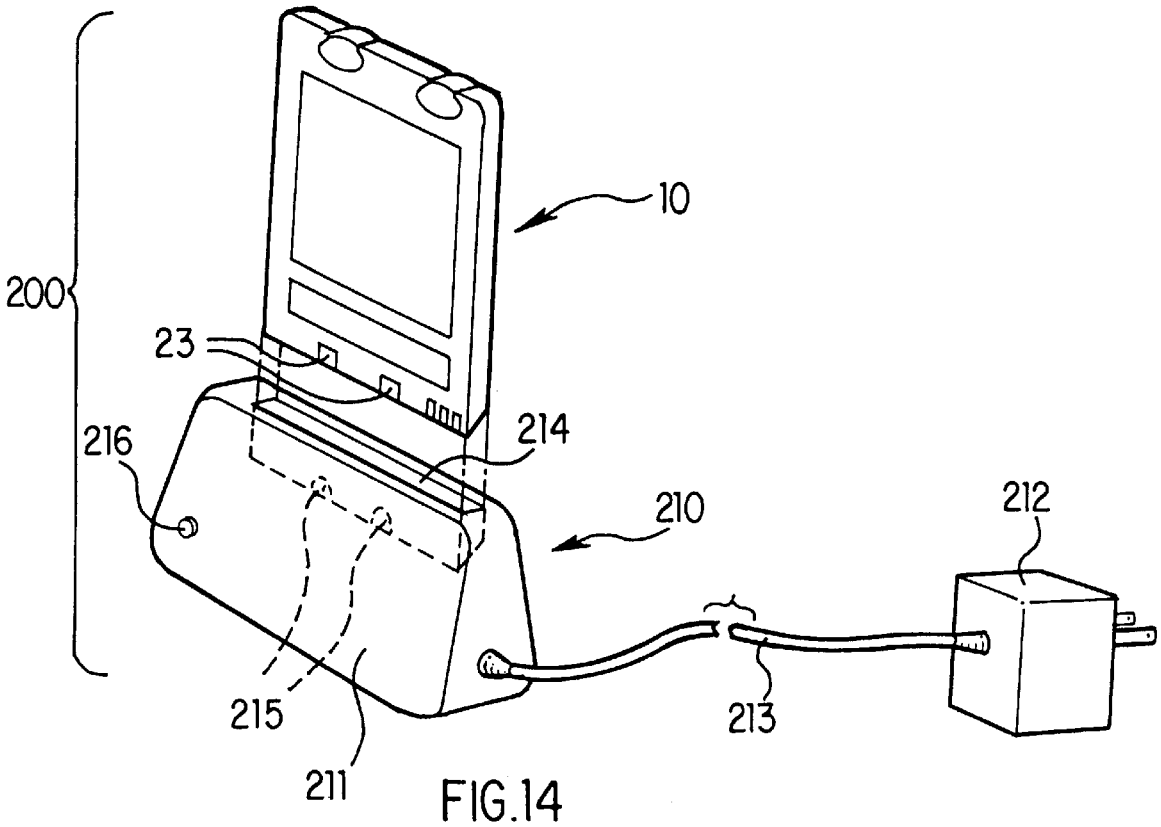
FIG. 14 is a perspective view of a kit including a multimedia collectible and a charging/display base.

Turning now to FIG. 14, a kit 200 is depicted which includes a multimedia collectible 10 and a charging base assembly 210. Charging base assembly 210 includes a receiving base 211 electrically connected via a power cord 213 to a voltage step-down transformer 212 which permits plugging thereof into a line voltage source. Receiving base 211 includes a receiving slot 214 having an upwardly facing opening for partially receiving multimedia collectible 10 therein. Advantageously, receiving slot 214 is of a depth sufficient to permit reception of only a minor base portion of multimedia collectible 10, thereby permitting receiving base to function as a display stand during charging, by allowing unobstructed viewing of the substantial remaining portion of multimedia collectible 10. Internal contacts 215 within receiving slot 214 provide charging voltage to rechargeable battery 109 via charging input 105 (both shown in FIG. 9) when multimedia collectible is received therein by contacting corresponding external battery contacts 23 carried on the lower edge of multimedia collectible 10. An optional indicator light 216 indicates when charging is complete.

Figure 15:
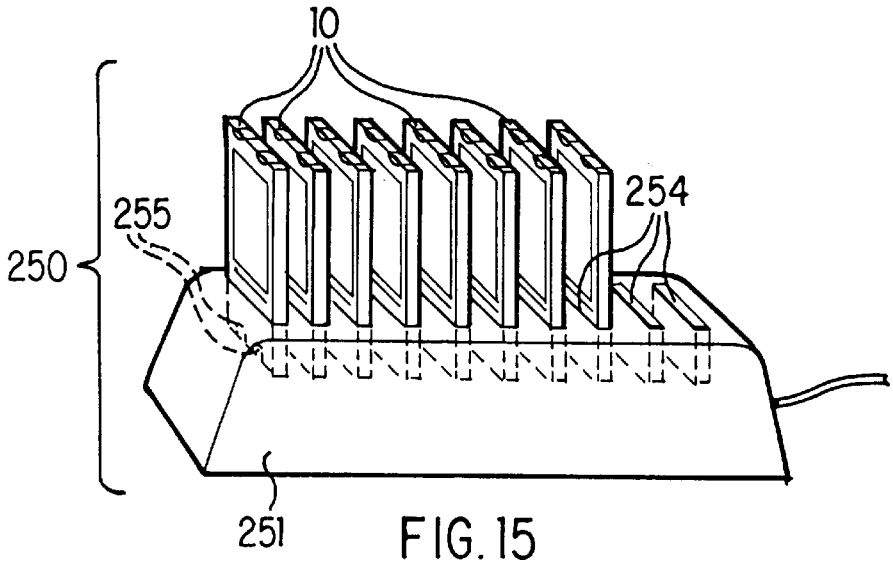
FIG. 15 is a perspective view of a kit including a plural set of multimedia collectibles and a charging/display base having multiple receiving slots for accommodating the set.

Turning now to FIG. 15, another kit is shown, comprising a plural set of card-like articles each equipped with a rechargeable battery supply, in combination with a charging base including means for accommodating the set for charging or display storage, the kit generally designated 250. Kit 250 includes a base 251 and one or more multimedia collectibles 10 of card-like format receivable in a plurality of receiving slots 254, at least a portion of which include means for transferring charging power to the cards when inserted therein, conveniently in the form of internal contacts 255 disposed at a lower position within receiving slots 254.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A multimedia collectible capable of presenting a particular subject of interest via a plurality of media representations, said multimedia collectible comprising:

a housing having structure presenting rigid exterior obverse and reverse sides;

said housing including means for receiving visual data, said visual data including at least one of a visual representation of the subject and textual information, in a manner permitting at least partial external viewing thereof from both said obverse and said reverse sides;

means integral with said housing for audibly reproducing at least one stored sound segment, said means for reproducing including external activation means;

said housing including a switch access hole formed crosswise to a plane of said housing, said switch access hole having an opening in at least one of said obverse and reverse sides; and said activation means including a biased activation switch disposed in said access hole for operable movement in a direction common to said plane of said housing, there being sufficient space between said biased activation switch and a peripheral inner boundary of said switch access hole to permit reception of a finger therethrough and allow depression of said switch against said biasing as desired.

2. A multimedia collectible capable of presenting a particular subject of interest via a plurality of media representations, said multimedia collectible comprising:

a housing;

said housing including means for receiving a visual representation of the subject in a manner permitting external viewing thereof;

means for storing at least one sound segment;

means integral with said housing for audibly reproducing said at least one sound segment, said means for reproducing including external activation means;

means for displaying stored alphanumeric data for viewing of same on a reverse side of said housing to a obverse side containing said visual representation; and means for selectively scrolling displayed text of said alphanumeric data for incremental display thereof;

a switch;

means for detecting which of two sides of said housing is oriented in an upwardly facing direction; and means, responsive to said means for detecting, for alternately changing a functional mode of said switch from one providing said activation means to one providing said means for selectively scrolling corresponding respectively to upward orientation of said obverse side and said reverse side.

3. The multimedia collectible in accordance with claim 2, wherein:

said means for detecting includes a detector switch;

said detector switch comprising a switch housing, said switch housing containing a conductive bead captively contained and movable therein; and said detector switch further comprising at least three contacts disposed in triangular arrangement with one another and having electrical contact surfaces exposed to an interior of said switch housing, movement of said bead within said switch housing bringing said bead into alternating conductive contact with ones of said at least three contacts and effecting a circuit closure when two of said at least three contacts are in contact with said bead at a given time, there being a distance between contacts permitting said circuit closure of only a portion of said at least three contacts at a time.

4. The multimedia collectible in accordance with claim 3, wherein said bead is a metal bearing.

5. The multimedia collectible in accordance with claim 3, wherein said bead is a quantity of mercury.

6. A multimedia collectible capable of presenting a particular subject of interest via a plurality of media representations, said multimedia collectible comprising:

a housing;

said housing including means for receiving a visual representation of the subject in a manner permitting external viewing thereof;

means for storing at least one sound segment; and means integral with said housing for audibly reproducing said at least one sound segment, said means for reproducing including external activation means; and means integral with said housing for permitting base-supported vertical display thereof when placed on a horizontal support surface, said means for permitting base-supported vertical display including two pairs of legs hingably connected to said housing proximal lower portions of opposed vertical edges thereof in a manner permitting individual legs of each of said two pairs to be hinged one in a direction outwardly of an obverse side of said housing, and a remaining one of said individual legs in a direction outwardly of a reverse side of said housing.

7. An integrated multimedia device permitting protective display of a card-like item and dimensionally enhancing a subject depicted thereby, the multimedia device comprising:

a flattened housing including structure defining an internally disposed receiving chamber for accommodating the card-like display item, the card-like display item being receivable therein;

said housing including an obverse side and a reverse side, said obverse side and said reverse side being optically transparent over at least area portions thereof to permit at least partial viewing of both sides of said card-like display item when same is received in said receiving chamber;

means for audibly reproducing at least one stored sound segment, said means for reproducing including external activation means;

said housing including a laminated structure comprising a first outer layer, a second outer layer and a separating layer disposed therebetween;

said separating layer including a shaped cutout defining an inner peripheral boundary of said receiving chamber, said shaped cutout having an opening along a peripheral edge of said housing for slidably receiving therethrough the card-like display item within said receiving chamber; and at least one of said first and second outer layers including a protruding central region, an outer peripheral boundary of which substantially matches said inner peripheral boundary of said receiving chamber defined by said shaped cutout in said separating layer, thereby permitting said receiving chamber to be cross-sectionally configured as desired to allow for proper receptional fit of said card-like display item.

8. A multimedia collectible capable of presenting a particular subject of interest via a plurality of media representations, said multimedia collectible comprising:

a housing;

said housing including means for receiving a visual representation of the subject in a manner permitting external viewing thereof;

means for storing at least one sound segment including means for recording a sound segment for future playback;

means integral with said housing for audibly reproducing said at least one sound segment, said means for reproducing including external activation means;

a switch, said switch alternately providing said external activation means and means for selectively initiating said means for recording;

means for changing a functional mode of said switch from one providing said external activation means to one providing said means for selectively initiating said means for recording;

said housing including a pin receiving chamber having contacts disposed therein; and said means for changing said functional mode of said switch including a recording pin, the presence of which in said pin receiving chamber determines said function of said switch.

* * * * *